US010967286B1

(12) United States Patent
Ho

(10) Patent No.: US 10,967,286 B1
(45) Date of Patent: Apr. 6, 2021

(54) DUAL-PURPOSE TOY TRAIN CAR HOUSING COVER

(71) Applicant: Wai Hoe Ho, Plano, TX (US)

(72) Inventor: Wai Hoe Ho, Plano, TX (US)

( * ) Notice: Subject to any disclaimer, the term of this patent is extended or adjusted under 35 U.S.C. 154(b) by 295 days.

(21) Appl. No.: 16/129,649

(22) Filed: Sep. 12, 2018

(51) Int. Cl.
*A63H 19/36* (2006.01)

(52) U.S. Cl.
CPC ..... *A63H 19/36* (2013.01)

(58) Field of Classification Search
CPC ..... A63H 19/36
See application file for complete search history.

(56) References Cited

U.S. PATENT DOCUMENTS 2,222,524 A * 11/1940 Wolf, Jr. ..... A47F 3/0443 62/252
3,851,938 A * 12/1974 McCowan ..... A47B 57/30 312/117
5,788,350 A * 8/1998 Fladung ..... A63H 33/04 312/244
5,924,778 A * 7/1999 TenBrink ..... A47F 3/004 312/107
5,961,149 A * 10/1999 Hunt ..... A63H 33/38 105/1.5
6,543,627 B1 * 4/2003 Schiavo ..... A47B 96/025 211/26
6,722,070 B2 * 4/2004 Ribaudo ..... A47G 1/12 40/735
7,316,459 B2 * 1/2008 TenBrink ..... A47B 45/00 312/114
9,084,483 B2 * 7/2015 Patterson ..... A47B 87/005
9,113,731 B2 * 8/2015 Brown ..... G09F 11/02
2005/0263473 A1 * 12/2005 TenBrink ..... A47B 45/00 211/189
2006/0021905 A1 * 2/2006 Johnson ..... A63H 19/36 206/736
2014/0265754 A1 * 9/2014 Patterson ..... A63H 19/36 312/111

FOREIGN PATENT DOCUMENTS

JP 2008086731 A * 4/2008

OTHER PUBLICATIONS

"Orbrium Toys 12 Pcs Wooden Engines & Train Cars Collection", 7 pps. <retrieved on Sep. 12, 2018 from: https://www.amazon.com/Orbrium-Toys-Collection-Compatible-Chuggington/dp/B01M6UFZNH>.

* cited by examiner

*Primary Examiner* — Zachary L Kuhfuss
(74) *Attorney, Agent, or Firm* — Law Office of Sam Sokhansanj PLLC

(57) ABSTRACT

A toy train car packaging container is disclosed that can include a removable cover that may be used as packaging and also in the building of a toy railway system. In particular, in one exemplary embodiment, a removable cover is disclosed that can couple to and be removed from a housing adapted to support one or more toy train car vehicles, tracks, and accessories. The removable cover can include a cut-away opening in its lower region representing an entry or exit point of a toy train car vehicle and allowing the toy train car to pass therethrough. In addition, a base is further provided to support the removable cover in a substantially upright configuration when assembled in a toy railway system configuration.

10 Claims, 6 Drawing Sheets

DUAL-PURPOSE TOY TRAIN CAR HOUSING COVER

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Generally, one of the favorite toys for many generations has been a toy train in which various wheeled toys simulating railway cars, wagons, or other vehicles are coupled together. Further, storage and carrying packages for such toy train cars are generally known in the art, and may take a variety of shapes and sizes depending on the desired package size, which is generally dependent on the size of the toy(s) to be stored therein. However, such packaging for toy train cars generally lacks any additional utility other than for the storage and housing of the toys. For example, in a situation where a child or user can open and remove one or more toy railway cars from the package, the package may not serve any additional utility afterwards and may even be discarded.

Hence, what is needed is a dual-purpose packaging container for a toy train railway that can not only store and transport the toy train cars, but also serve an additional utilitarian function in the building of a toy railway system.

BRIEF SUMMARY

In one aspect of the disclosure described herein, a toy train car packaging container is disclosed that can include a removable cover that may be used as a packaging lid or cover and also used in the building of a toy railway system and configuration. In particular, in one exemplary embodiment, a removable cover is disclosed that can couple to and be removed from a housing adapted to support one or more toy train car vehicles, tracks, and accessories. The removable cover can include a cut-away opening in its lower region representing an entry or exit point of a toy train car vehicle and allowing the toy train car to pass therethrough. In addition, a base is further provided to support the removable cover in a substantially upright configuration when assembled in a toy railway system configuration.

In another aspect of the disclosure described herein, a dual-purpose removable cover system is disclosed having a housing adapted to support one or more toy train car vehicles, tracks, and accessories. In one exemplary embodiment, the system can further include a removable cover coupled to the housing, a cut-away opening in a lower region of the cover, and a base adapted to support the removable cover in a substantially upright configuration. The cover system can further include one or more channels for receiving the removable cover therein, such that the removable cover slides in or out of the channels. In addition, the cut-away opening comprises indicia in or around it depicting one or more of an entry or exit point for the one or more toy vehicles, wherein the indicia can further depict one or more of a tunnel, bridge, gate, or door frame. Here, the cut-away opening is sized to receive the one or more toy vehicles therethrough. Further, the base can include a slot or groove therein for receiving the removable cover. The base can further include a pair of upright flanges extending near the slot or groove of the base. In addition, the housing can further include one or more shelves for supporting one or more toy train cars thereon.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

Figure 1:
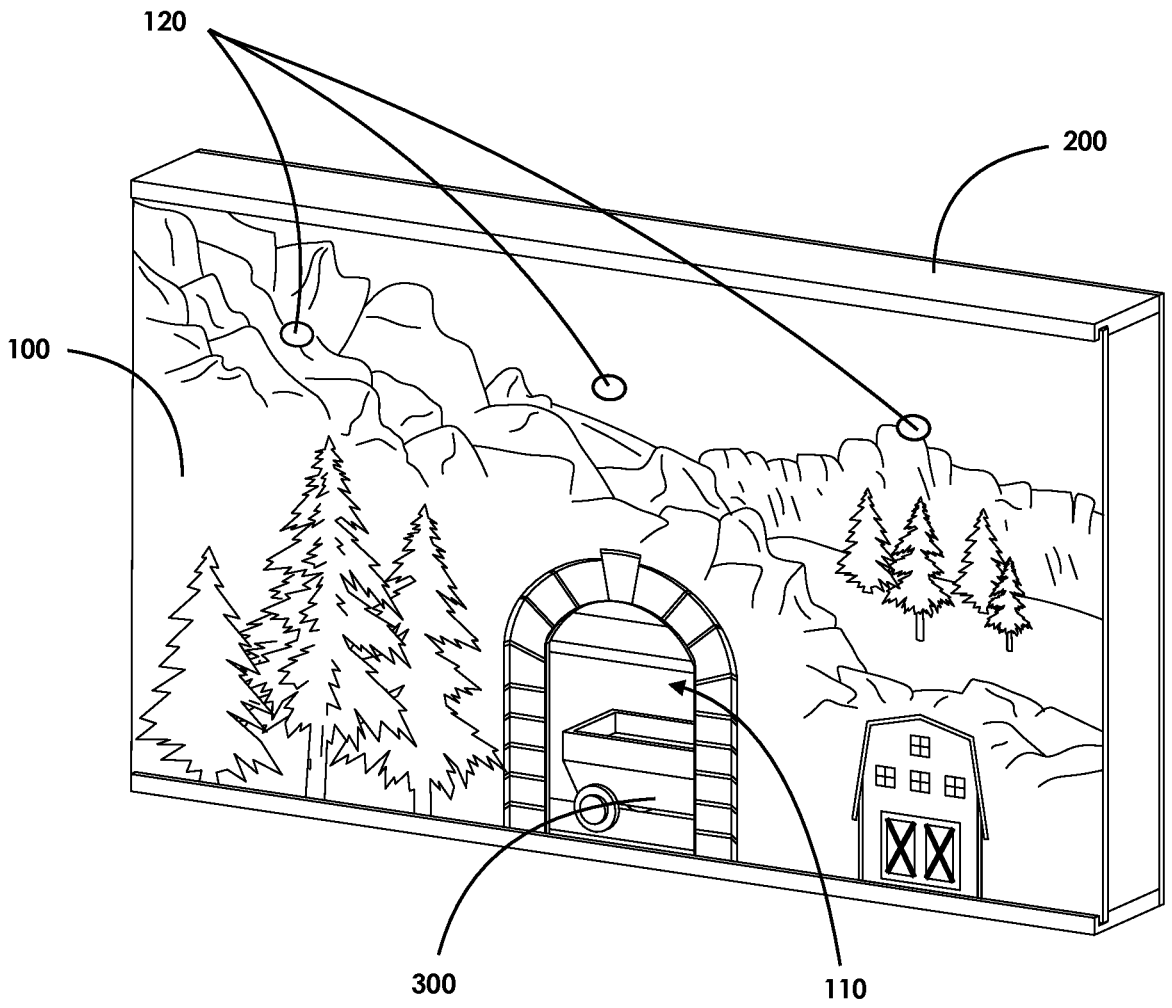
FIG. 1 illustrates perspective view for one non-limiting exemplary embodiment of the dual-purpose removable cover and casing of the present disclosure described herein.
Figure 2A:
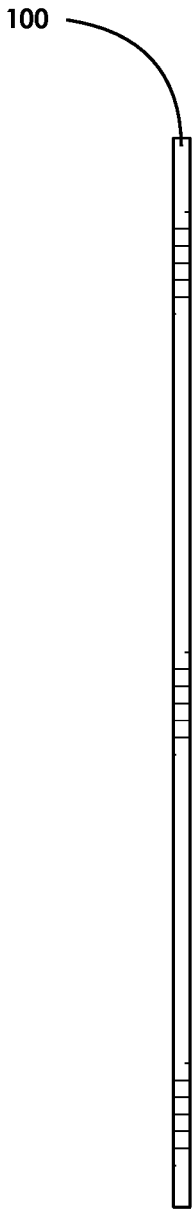
FIG. 2A illustrates a left or right side view of the dual-purpose removable cover of the present disclosure described herein
Figure 2B:
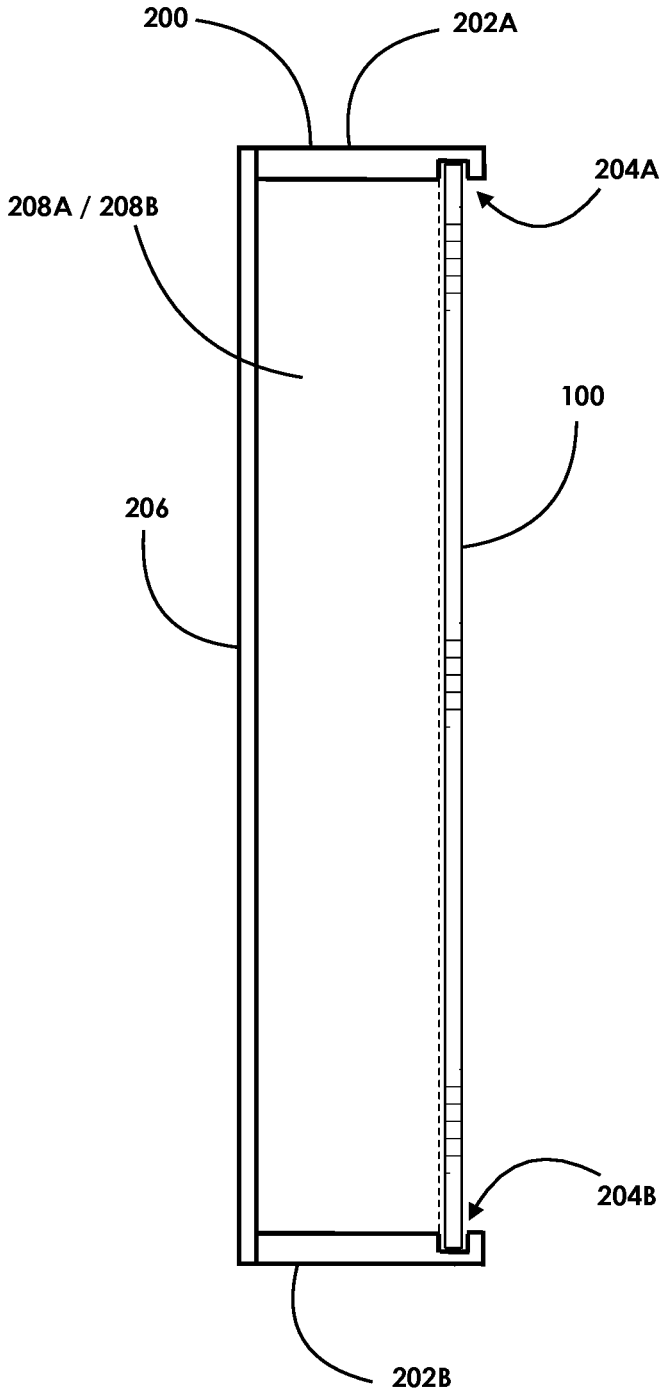
FIG. 2B illustrates a partial cross-sectional left or right side view of the dual-purpose removable cover of the present disclosure described herein shown assembled on the casing of the present disclosure described herein.
Figure 3:
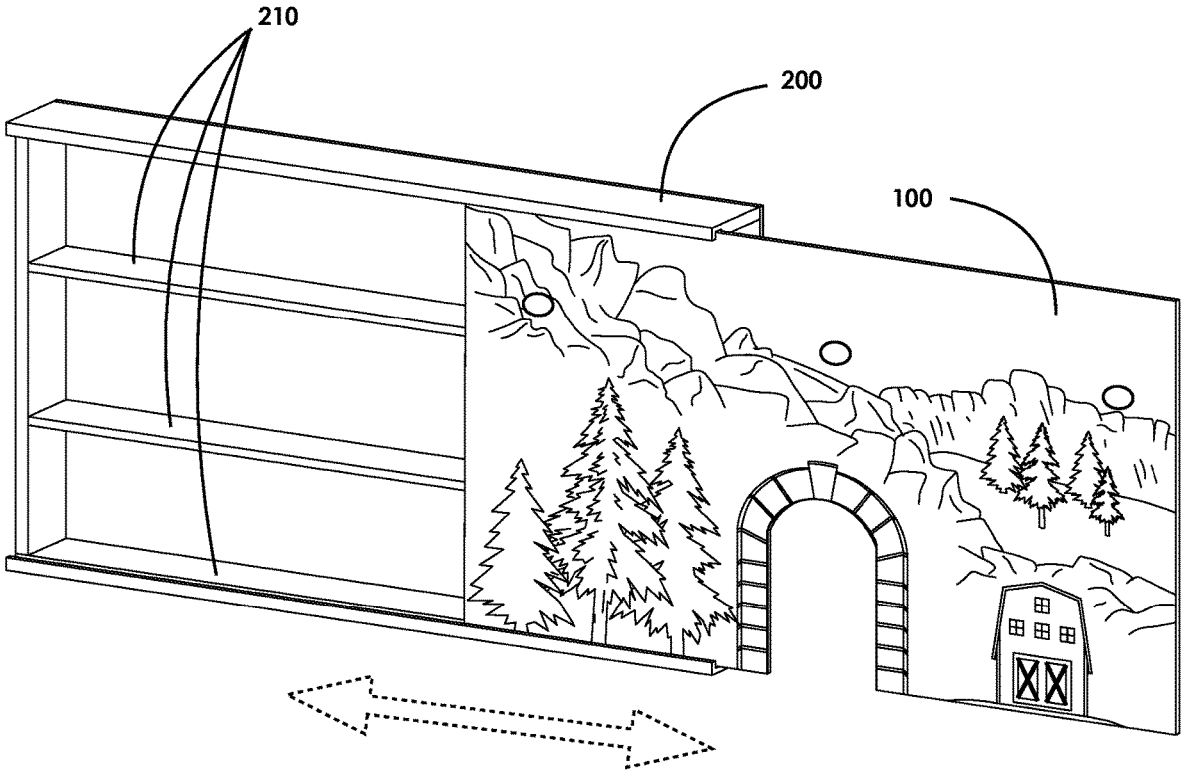
FIG. 3 illustrates perspective view for one non-limiting exemplary embodiment of a method of inserting or removing the dual-purpose removable cover of the present disclosure described herein.
Figure 4A:
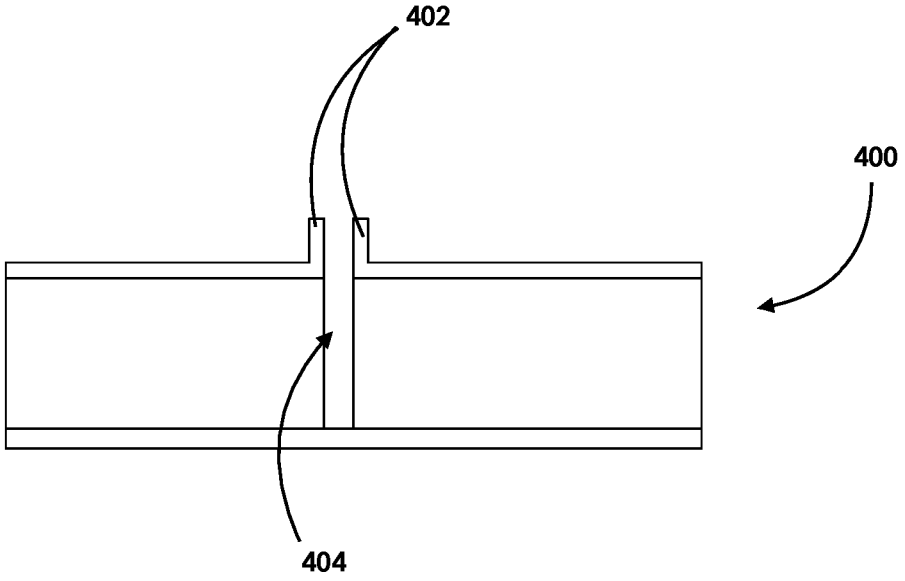
FIG. 4A illustrates a left or right side view for one non-limiting exemplary embodiment of a base for holding the dual-purpose removable cover of the present disclosure described herein in an upright position.
Figure 4B:
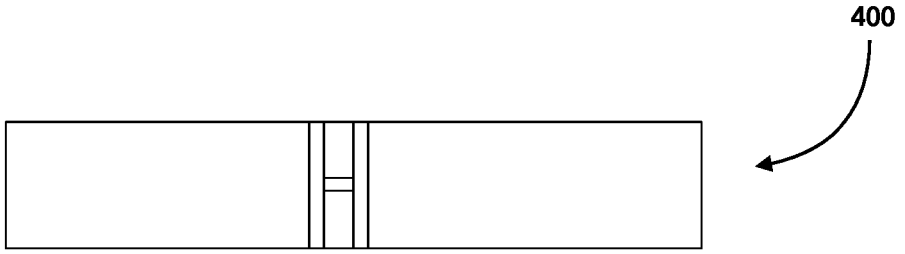
FIG. 4B illustrates a top view of the base shown in FIG. 4A.
Figure 4C:
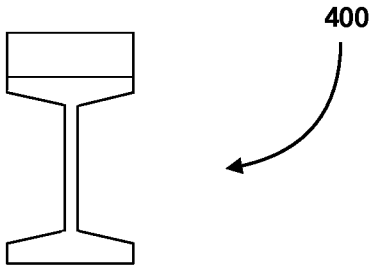
FIG. 4C illustrates a front or rear view of the base shown in FIG. 4A.

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

FIGS. 1-6 illustrate various non-limiting exemplary embodiments for the dual-purpose removable cover of the present disclosure described herein. In general, referring to FIGS. 1-3, the dual-purpose removable lid or cover 100 is shown being slidably inserted into or removed from a toy train car housing or casing 200, as one packaging box or assembly. In general, housing 200 can include multiple shelves 210 that can store therein one or more railroad toy train cars 300; however, it is contemplated within the scope of the present disclosure described herein that housing 200 may also store any other type of article, such as other toy-based vehicles, planes, cars, dolls, action figures, or the like. In addition, housing 200 can generally be comprised of several pieces adhered or affixed together. For example, housing 200 can include left and right sides 208A and 208B which further support shelves 210, and are further secured to back region 206 that is further secured to top and bottom regions 202A and 202B. Here, it is contemplated within the scope of the present disclosure described herein that any of components 202A, 202B, 208A, 208B, and 206 may be secured to each other via any type of fastening member, such as one or more adhesives, screws, nails, dowels, dove tail attachment, among others. In addition, any of the aforementioned components 202A, 202B, 208A, 208B, and 206 may be made of wood, particle wood, composite, plastic, polymers, metal, or aluminum, among others. Further, each of sides 202A and 202B include cutout grooves or channels 204A and 204B that can extend the length of housing 100. Here, each of channels 204A and 204B are configured to receive the slidable insert cover 100 therein.

Still referring to FIGS. 1-6, lid or cover 100 is shown having any type of indicia, visual, or graphical representation thereon. For example, in one embodiment, cover 100 is shown having a landscape type of backdrop representation; however, it is contemplated within the scope of the present disclosure described herein that cover 100 may also include any other type of visualization, such as learning or educational type of indicia, language or number based background, earth/sea/sky/water/city/location/architectural type of backdrop, or animal background, among others, and in a one-dimensional format or 2-dimensional (holographic) type of format. In addition, cover 100 may also be comprised of a digital based graphical video screen display, which may be pre-programmed (or controlled) to include various types of graphical generated images or indicia. Further, cover 100 may have any dimension or thickness and be made of any suitable material, including but not limited to cardboard stock, wood, particle wood, fiber composites, plastic, polymers, metal, among others.

Still referring to cover 100, the cover may include an opening 110 therein adapted to provide a first purpose of allowing the articles, such as car 300, to be displayed within housing 200 to be displayed therethrough, and a second purpose of allowing cover 100 to be used in an assembly thereby allowing the article housed within housing 200, such as car 300, to be passed therethrough. In addition, opening 110 is shown to further allow a toy railroad track 310 to further be passed therethrough. Here, opening 110 is further shown with indicia 110A that can illustrate a visual tunnel-like formation with a brick or stone-like illustration, such as a tunnel passing through an illustrated mountainous region or terrain. Here, opening 110 is shown in one non-limiting exemplary embodiment generally having an arcuate or curved upper region configuration; however, it is contemplated within the scope of the present disclosure described herein that opening 110 may also take any configuration, such as rectangular, square, triangular, polygon having three or more side, symmetrical, or an asymmetrical presentation. For example, bordering or outline indicia 110 may illustrate any type of entry or exit point, such as a tunnel, bridge, door frame, or gate, among others. In addition, cover 100 can further include any type of indicia or graphical representation 100A on either of its front or rear sides, such as one illustration on one side and a corresponding/associated (or different) illustration on its opposing side. For example, one side can illustrate an entry point (entrance) and the opposing side can illustrate an exit point, or vice versa.

Figure 5:
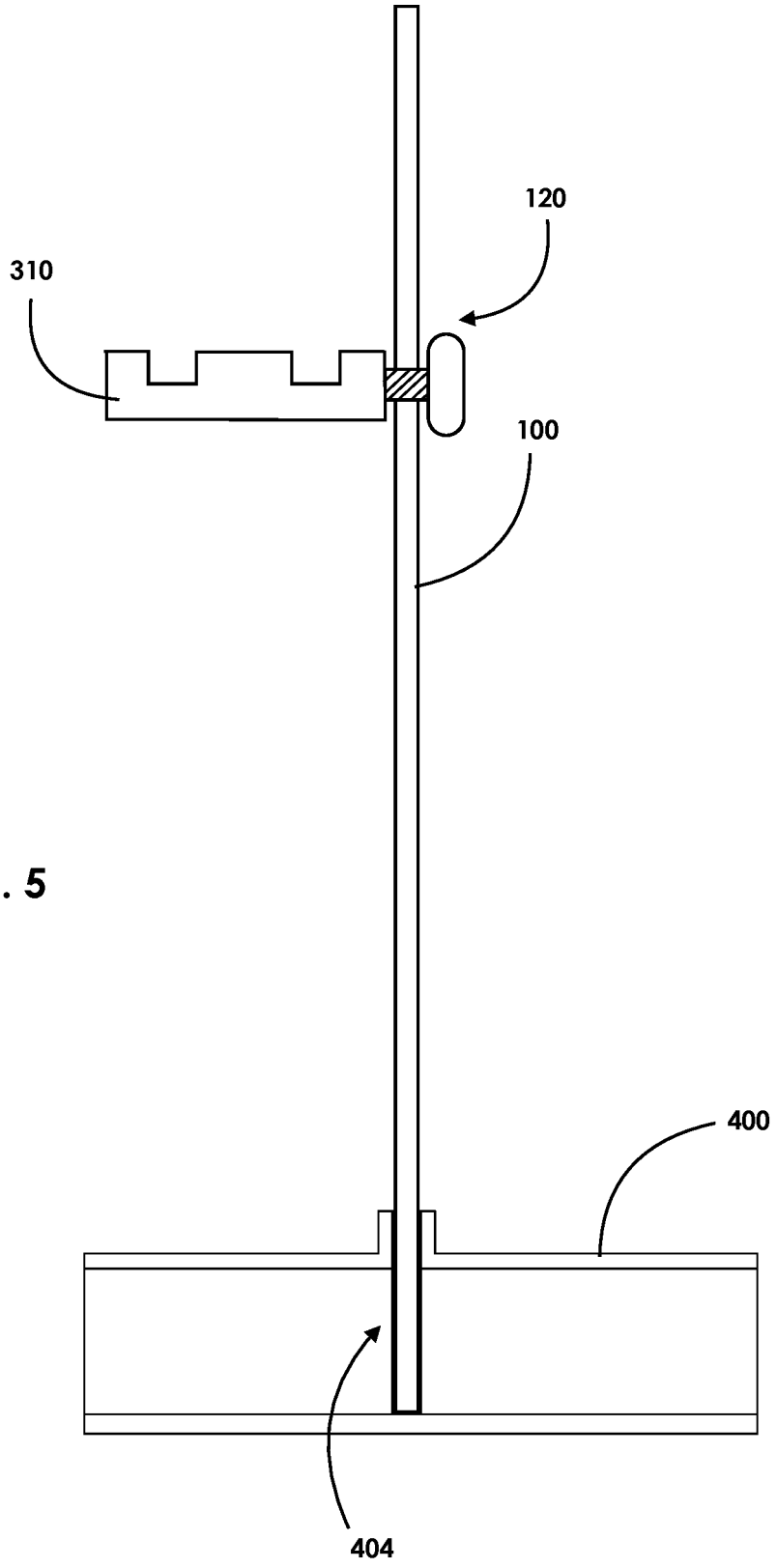
FIG. 5 illustrates a left or right side view of the base for supporting the dual-purpose removable cover of the present disclosure described herein.

Still referring to cover 100, the cover may include one or more cut-out openings 120 therein. Here, openings 120 can be adapted to operate as anchor points for attaching or securing various components to cover 100. Specifically, openings 120 can received one or more connections or threaded protrusions for tracks 310 therethrough (and secured on an opposing side, such as via a threaded nut), as shown in FIG. 5. In such a configuration, cover 100 can further support multiple raised, suspended, or overhead tracks extending above opening 110 in an assembled configuration. Accordingly, openings 120 can further provide additional purpose, use, and educational and learning aspects. For example, a child or user assembling the toy tracks can have multiple options for configuring and assembling tracks in a toy train railroad system.

Figure 6:
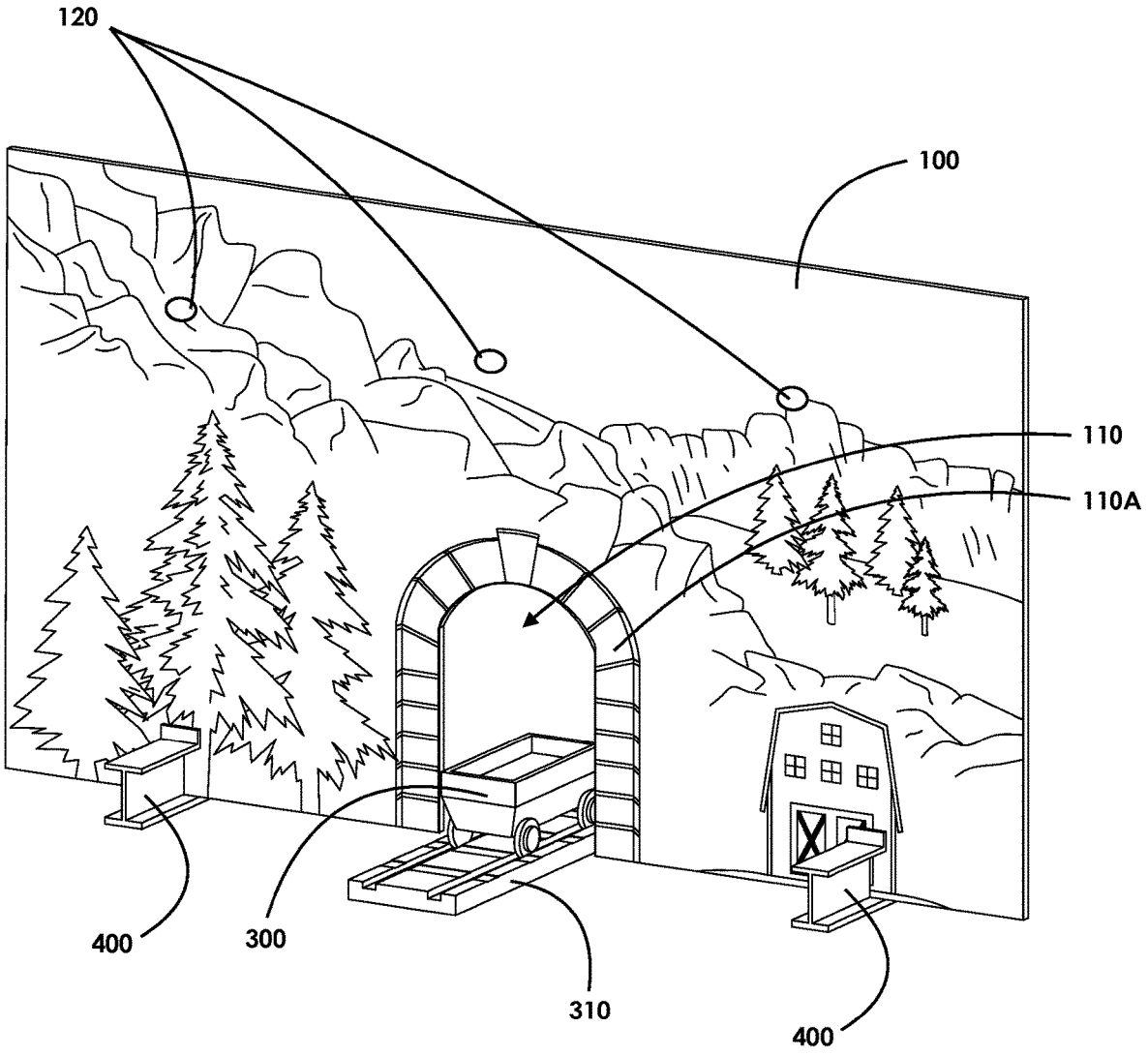
FIG. 6 illustrates a perspective view of the dual-purpose removable cover of the present disclosure described herein shown assembled on the base, according to one non-limiting exemplary embodiment of the present disclosure described herein.

Referring now to FIGS. 4A-6, the dual-purpose removable cover of the present disclosure described herein is further shown having a support stand, pier, or base 300. In particular, base 400 is shown having an I-beam type of configuration. In addition, base 400 further includes an opening, cut-out, notch, slot, groove, or channel 404 therein, such that it securely receives the lower region of cover 100 therein. Here, opening 404 is sized such that it can receive cover 100 therein whereby cover 100 is securely held substantially upright or in a vertical orientation, and wherein cover 100 may be slightly suspended once received therein. Here, cover 100 may either by slightly loosely fitted within opening 404 or be tightly fitted within opening 404 via a friction fit. In addition, base 400 further includes a pair of upright lips or flanges 402 that can further support cover 100 in the upright position and prevent the cover from tilting substantially frontwards or rearwards, as shown in FIGS. 5 and 6, thereby providing a stable configuration. Generally, at least two bases 400 are preferred to support cover 100 in the upright configuration; however, it is contemplated within the scope of the present disclosure described herein that any number of bases 400 may also be used to support or stabilize the cover, such as one or three or more bases 400. For example, if cover 100 is configured to support multiple tracks, via anchor points 120, then additional bases 400 may be added to support or stabilize the additional weight of cover 100 and prevent tipping.

From the foregoing it will be seen that the present disclosure described herein is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A dual-purpose removable cover system, comprising:
a housing;
a first shelf and a second shelf within the housing each adapted to support one or more toy vehicles, wherein the second shelf is disposed above the first shelf;
a cover adapted to couple to and decouple from the housing;
a cut-away opening in a lower region of the cover; and
a first base and a second base each independent of the housing, wherein each of the first base and the second base receive the cover therein and support the cover in a substantially upright configuration such that the one or more toy vehicles pass through the cut-away opening.

2. The dual-purpose removable cover system of claim 1, wherein the housing further comprises one or more channels for receiving the cover therein, such that the cover slides in or out of the channels.

3. The dual-purpose removable cover system of claim 1, wherein the cut-away opening comprises indicia in or around the cover depicting one or more of an entry or exit point for the one or more toy vehicles.

4. The dual-purpose removable cover system of claim 1, wherein the indicia further depicts at least one of a tunnel entrance or exit, bridge entrance or exit, gate entrance or exit, door frame entrance or exit.

5. The dual-purpose removable cover system of claim 1, wherein the cut-away opening is sized to receive the one or more toy vehicles therethrough.

6. The dual-purpose removable cover system of claim 1, wherein the base further includes a slot or groove therein for receiving the cover.

7. The dual-purpose removable cover system of claim 6, wherein the base further includes a pair of upright flanges extending near the slot or groove of the base.

8. The dual-purpose removable cover system of claim 1, wherein the cover further comprises one or more anchor points.

9. A dual-purpose removable cover system, comprising:
a housing having a top channel and bottom channel;
a plurality of shelves within the housing each adapted to support one or more toy vehicles;
a cover adapted to slide within the top channel and the bottom channel of the housing;
a cut-away opening in a lower region of the cover; and
a first base and a second base, wherein each of the first base and second base are positioned in a substantially perpendicular configuration with respect to the cover and receive the cover therein.

10. A dual-purpose removable cover system, comprising:
a housing having a first channel and a second channel;
a plurality of shelves within the housing each adapted to support one or more toy vehicles;
a cover adapted to slide within the first channel and the second channel of the housing;
a cut-away opening in a lower region of the cover; and
a first stand and a second stand, wherein each of the first stand and second stand comprise a slot in a middle region of each of the first stand and second stand, and wherein the slot receives receives the cover therein such that the cover is in a substantially upright configuration.

* * * * *